US007832797B2

(12) United States Patent
Miyakawa

(10) Patent No.: US 7,832,797 B2
(45) Date of Patent: Nov. 16, 2010

(54) FOLDABLE FURNITURE

(76) Inventor: Takeshi Miyakawa, 63 N. 3rd St., Brooklyn, NY (US) 11211

( * ) Notice: Subject to any disclaimer, the term of this patent is extended or adjusted under 35 U.S.C. 154(b) by 386 days.

(21) Appl. No.: 11/728,997

(22) Filed: Mar. 27, 2007

(65) Prior Publication Data

US 2008/0238156 A1 Oct. 2, 2008

(51) Int. Cl.
*A47C 4/00* (2006.01)

(52) U.S. Cl. ..... 297/129; 297/17; 297/34; 297/52; 297/376

(58) Field of Classification Search ..... 297/17, 297/31, 34, 51, 52, 53, 54, 129, 364, 376, 297/378.14
See application file for complete search history.

(56) References Cited

U.S. PATENT DOCUMENTS 630,427 A * 8/1899 Turner ..... 190/2
D134,806 S * 1/1943 Brown et al. ..... D6/368
2,570,842 A * 10/1951 O'Connor ..... 190/8
2,593,319 A * 4/1952 Levitin et al. ..... 5/657
D167,514 S * 8/1952 Hicks ..... D6/335
2,692,639 A * 10/1954 Genovese ..... 297/105
2,693,846 A * 11/1954 Luttio ..... 297/105
5,121,961 A * 6/1992 Marshall ..... 297/17
6,270,155 B1 * 8/2001 Rashid ..... 297/1
7,309,101 B2 * 12/2007 True ..... 297/118

* cited by examiner

*Primary Examiner*—Joseph F Edell
(74) *Attorney, Agent, or Firm*—Day Pitney LLP

(57) ABSTRACT

A foldable chair that is convertible to either a seat or a table that includes a laterally extending wedge shaped frame, a backrest, a leg, and a seat. The chair includes two chambers for respectively receiving the backrest and the leg. The backrest and the leg are pivotally connected to the seat. The chair includes a locking structure for securing the backrest and leg in either of a retracted or extended state. In the retracted state, the backrest and leg are flush with the frame.

8 Claims, 14 Drawing Sheets

FOLDABLE FURNITURE

BACKGROUND OF THE INVENTION

Most foldable furniture pieces are designed for easy storage and transport. In particular, the design of a foldable chair is such that when the chair is in a folded state, and all movable components are retracted, the aesthetics of the design prevent the chair from being used as a display piece. Furthermore, foldable chairs do not offer a partial folded state, where some movable components are retracted and some are extended, in which the chair still functions as a usable chair. In addition, foldable chairs typically have complicated structural systems and foldable mechanisms with many parts so that significant time is required for manufacturing and assembling the chair. To achieve a desired aesthetic, the design of the chair tends to include small and delicate structural members whereby the chair become flimsy over time and the useful life of the chair is reduced. Furthermore, the foldable mechanisms systems are often designed so that complicated procedures and/or tools are required to retract and extend the chair components.

BRIEF SUMMARY OF THE INVENTION

It is therefore an object of this invention to provide a foldable chair that has an attractive appearance and functions as a chair when unfolded and partially folded. Another object of invention is to provide a foldable chair that is structurally stable and durable. Still another object of invention is to provide a foldable chair that is easy to fold and unfold.

A main body of the foldable furniture comprises triangular shaped sidewalls and a seat, where the main body has two chambers to house a leg and a backrest when they are retracted or folded away. Both the leg and the backrest are pivotally connected to the sidewalls, such that when the leg and backrest are retracted they are covered within the triangular profile shape so that the furniture forms a wedged shape. This geometry enables the use of the furniture piece as either a table or a seat in the retracted state. The foldable furniture has two movable components: the leg and the back. The structure includes a chamber within the main body which is capable of supporting the leg when the leg is extended for making the foldable furniture stable and durable. The combination of automatic locking system and a one touch release system enables fixing the leg and the backrest in either the extended or retracted state as well as easy manipulation of the leg and backrest from one of the extended and retracted state to the other of the extended and retracted state.

BRIEF DESCRIPTION OF THE FIGURES

To further satisfy the recited objectives, a detailed description of typical embodiments of the invention is provided with reference to appended drawings that are not intended to limit the scope of the invention, in which.

DESCRIPTION OF THE EMBODIMENTS

Figure 1:
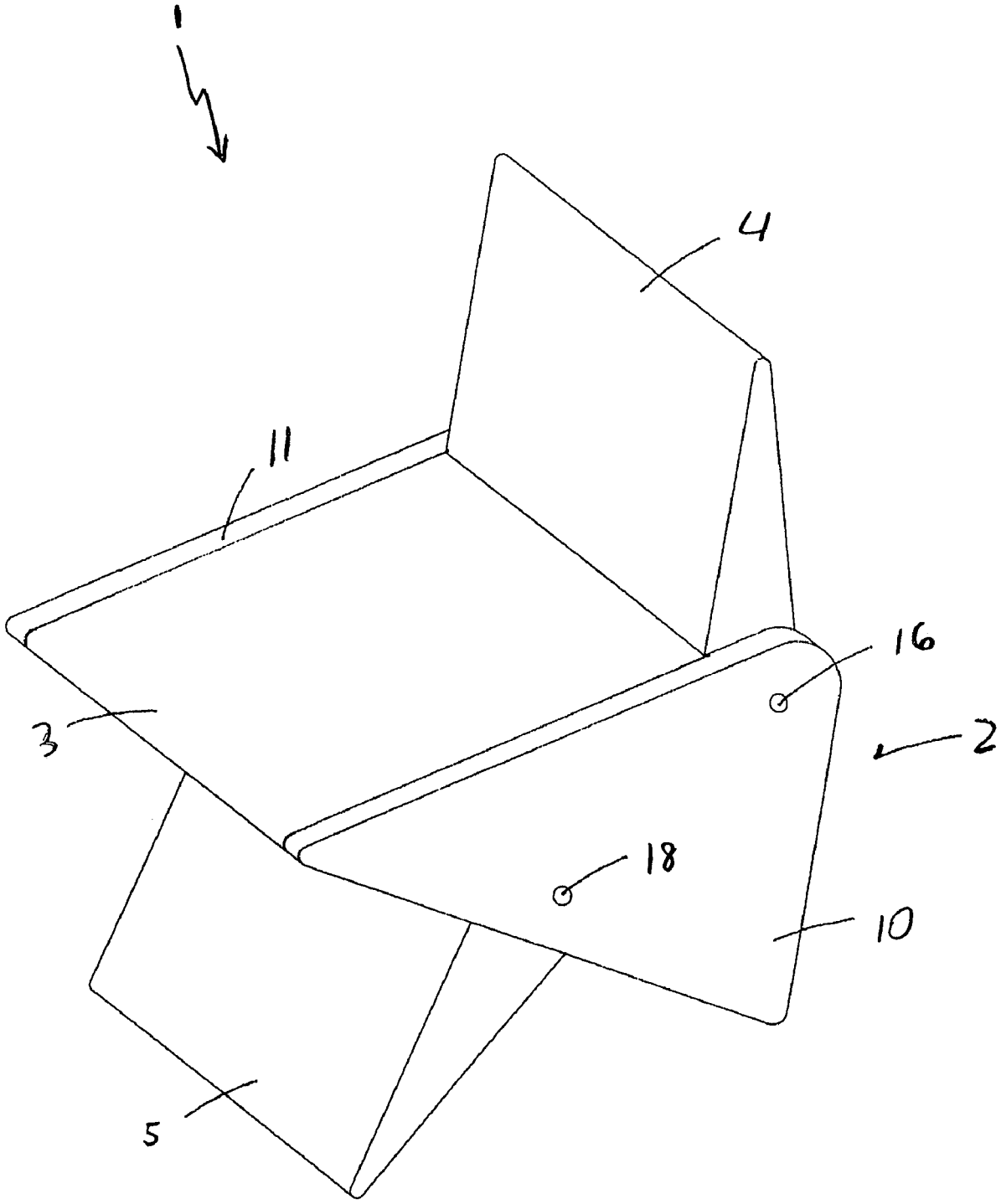
FIG. 1 is a perspective view of a foldable chair where the backrest and leg are both extended.
Figure 2:
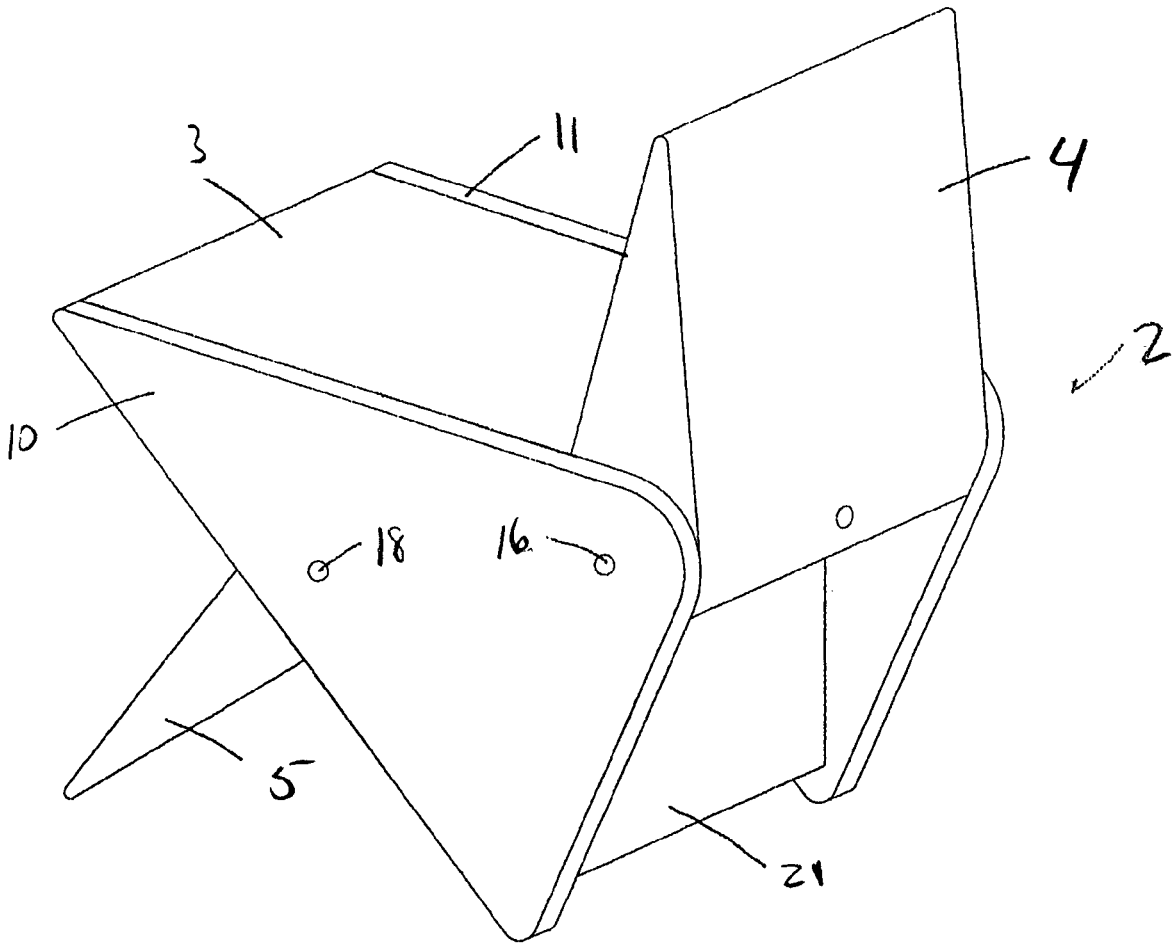
FIG. 2 is another perspective view of the foldable chair where the backrest and leg are extended.
Figure 7:
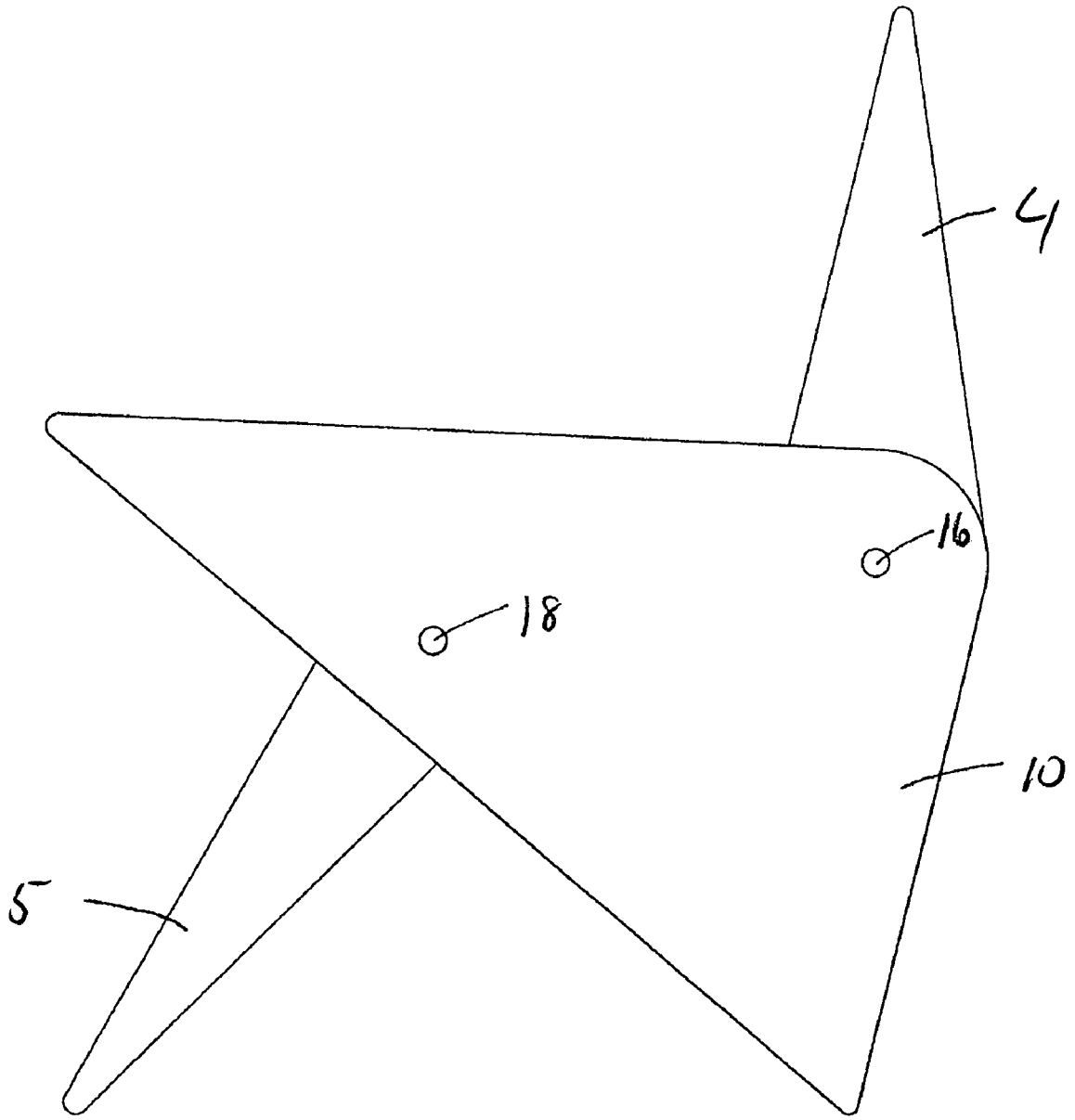
FIG. 7 is a side elevational view of the foldable chair where the backrest and leg are extended.
Figure 8:
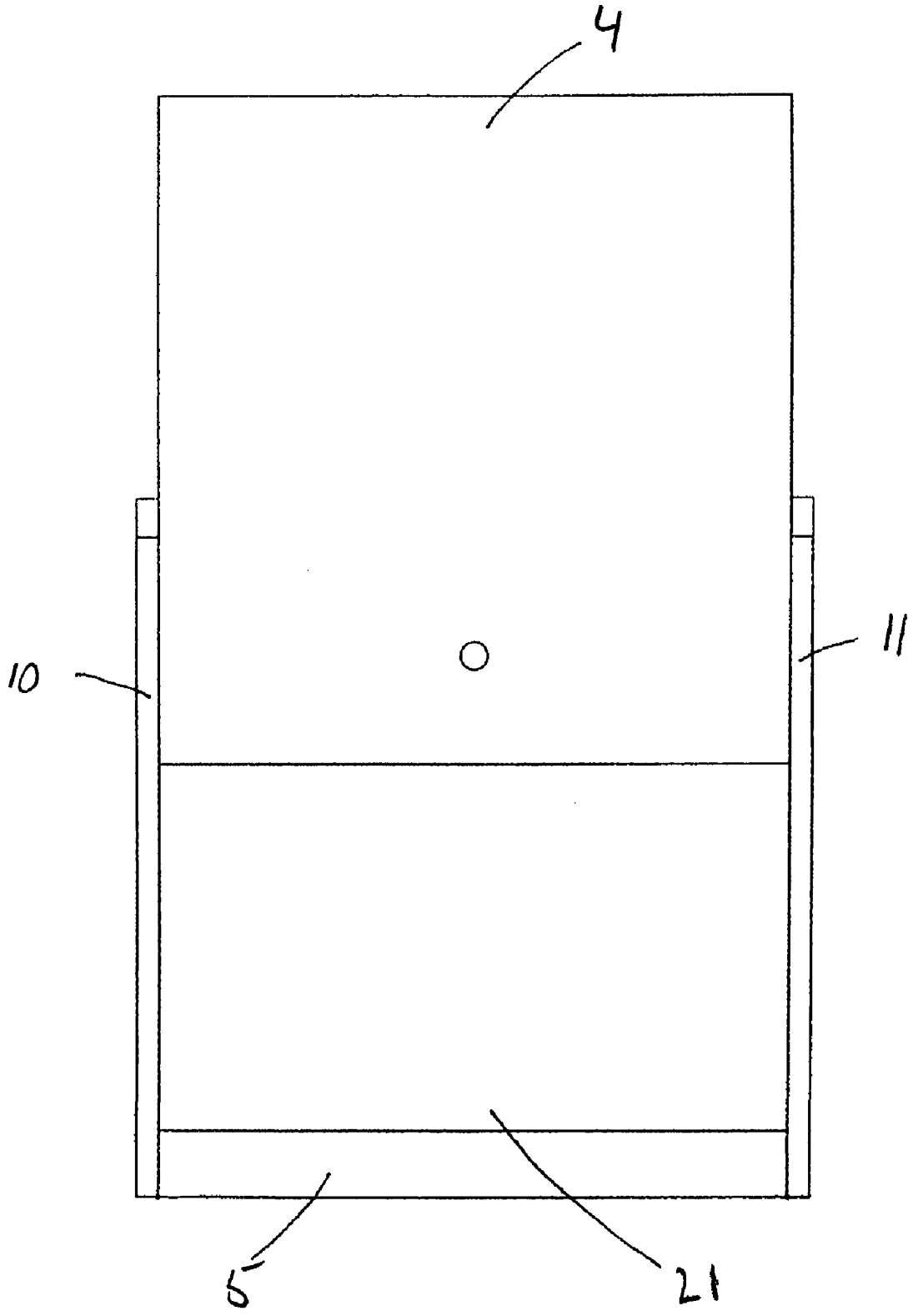
FIG. 8 is a rear elevational view of the foldable chair where the backrest and leg are extended.
Figure 9:
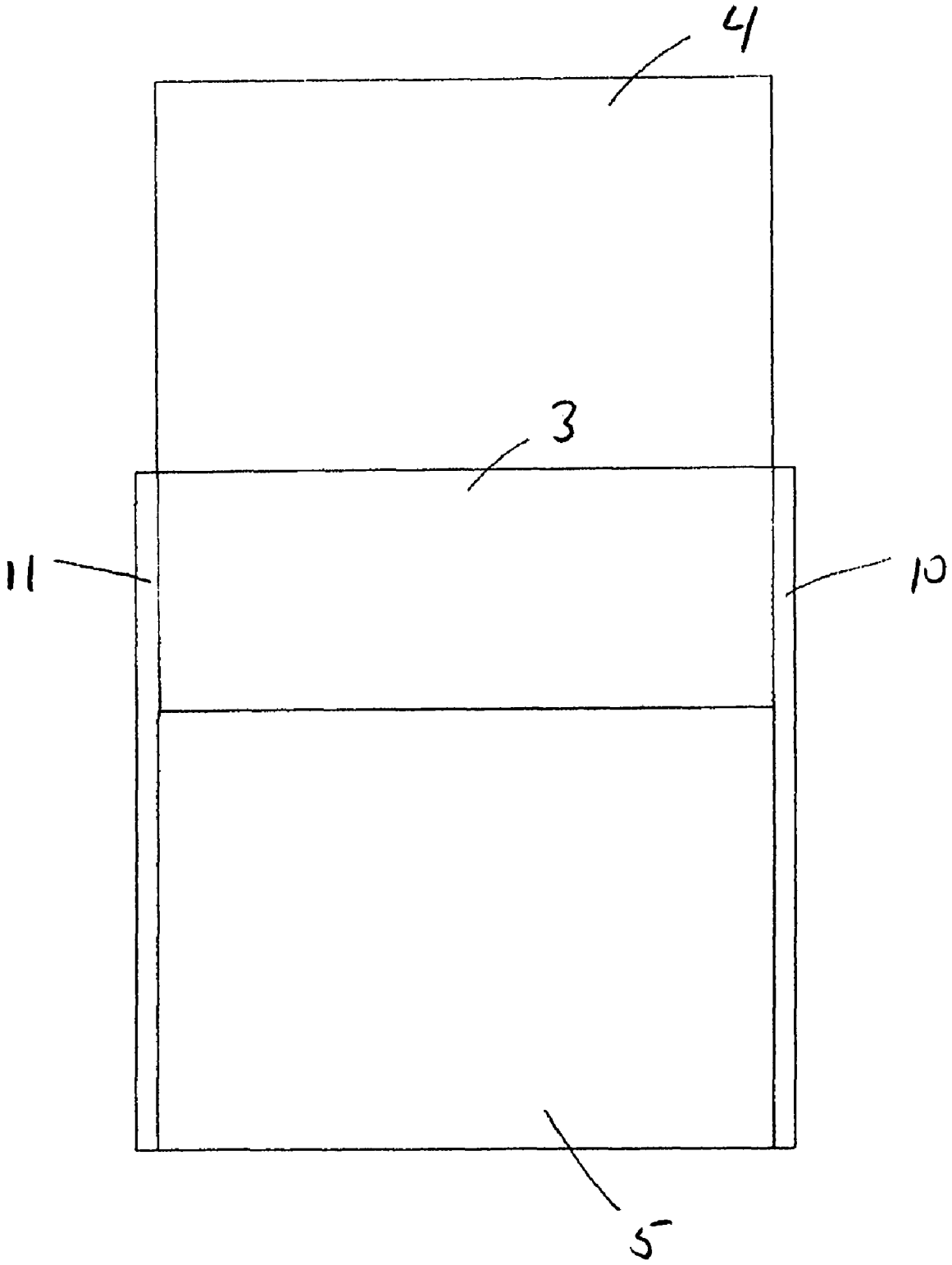
FIG. 9 is a front elevational view of the foldable chair where the backrest and leg are extended.

Turning to FIG. 1, a foldable chair 1 is provided comprising a wedge shaped frame 2, a seat 3, a backrest 4, and a leg 5. The backrest 4 and the leg 5 are pivotally connected to the seat 3 and the chair 1 for enabling extending and retracting thereof. The chair 1 includes first and second chambers 6 and 7 (FIG. 7) disposed within the frame 2 for respectively receiving the backrest 4 and the leg 5 when two are retracted. The chair includes first and second locking means 8, 9 (FIG. 10) for securing the backrest 4 and leg 5 in either an extended or a retracted state.

The frame 2 includes first and second opposing parallel side walls 10, 11 having a same shape and size. The seat 3 fixedly extends between the first and second sidewalls 10, 11 and the backrest 4 and leg 5 are pivotally disposed between the first and second sidewalls 10, 11.

Figure 4:
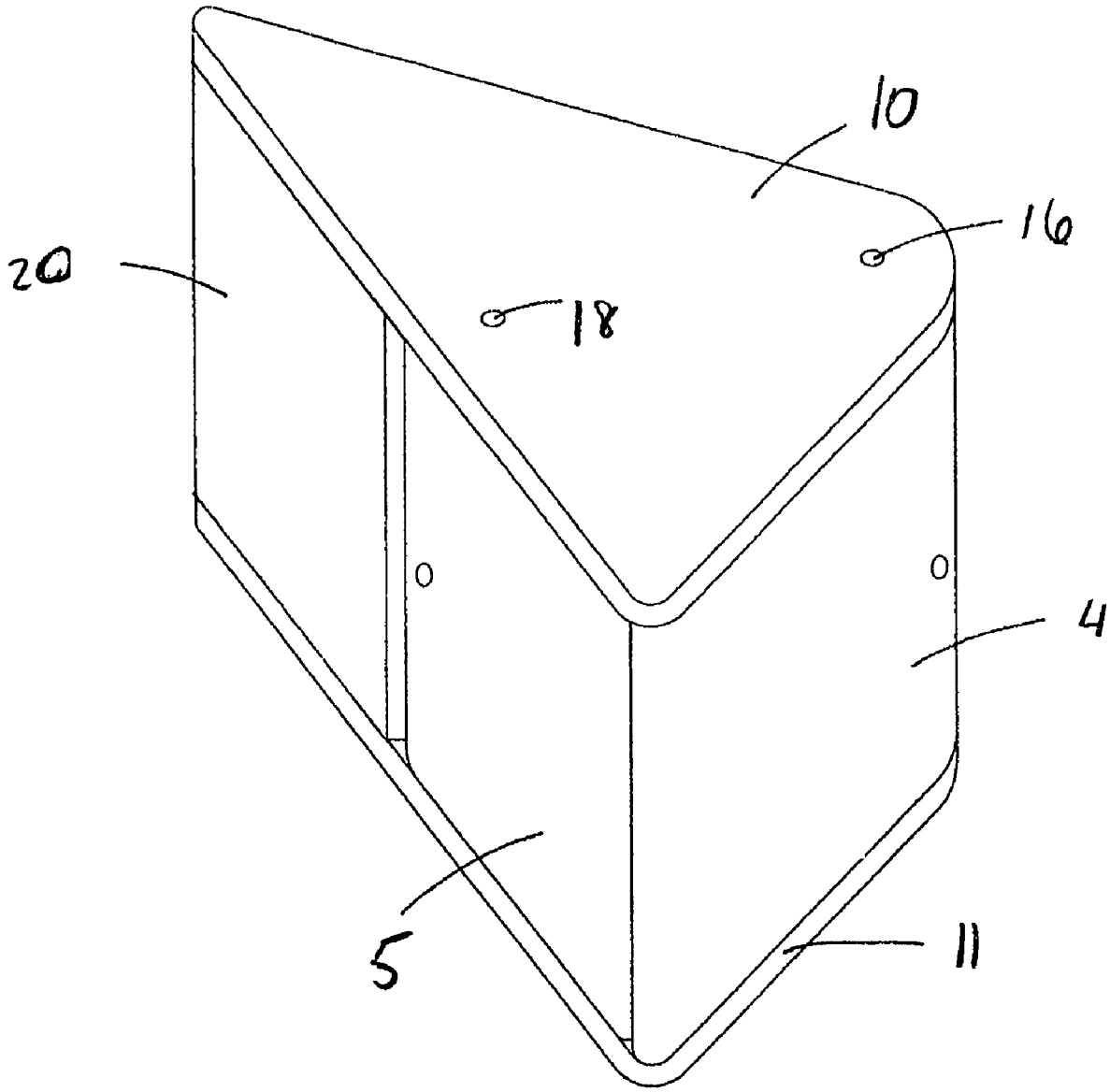
FIG. 4 is a perspective view of the foldable chair where the backrest and leg are retracted.
Figure 12:
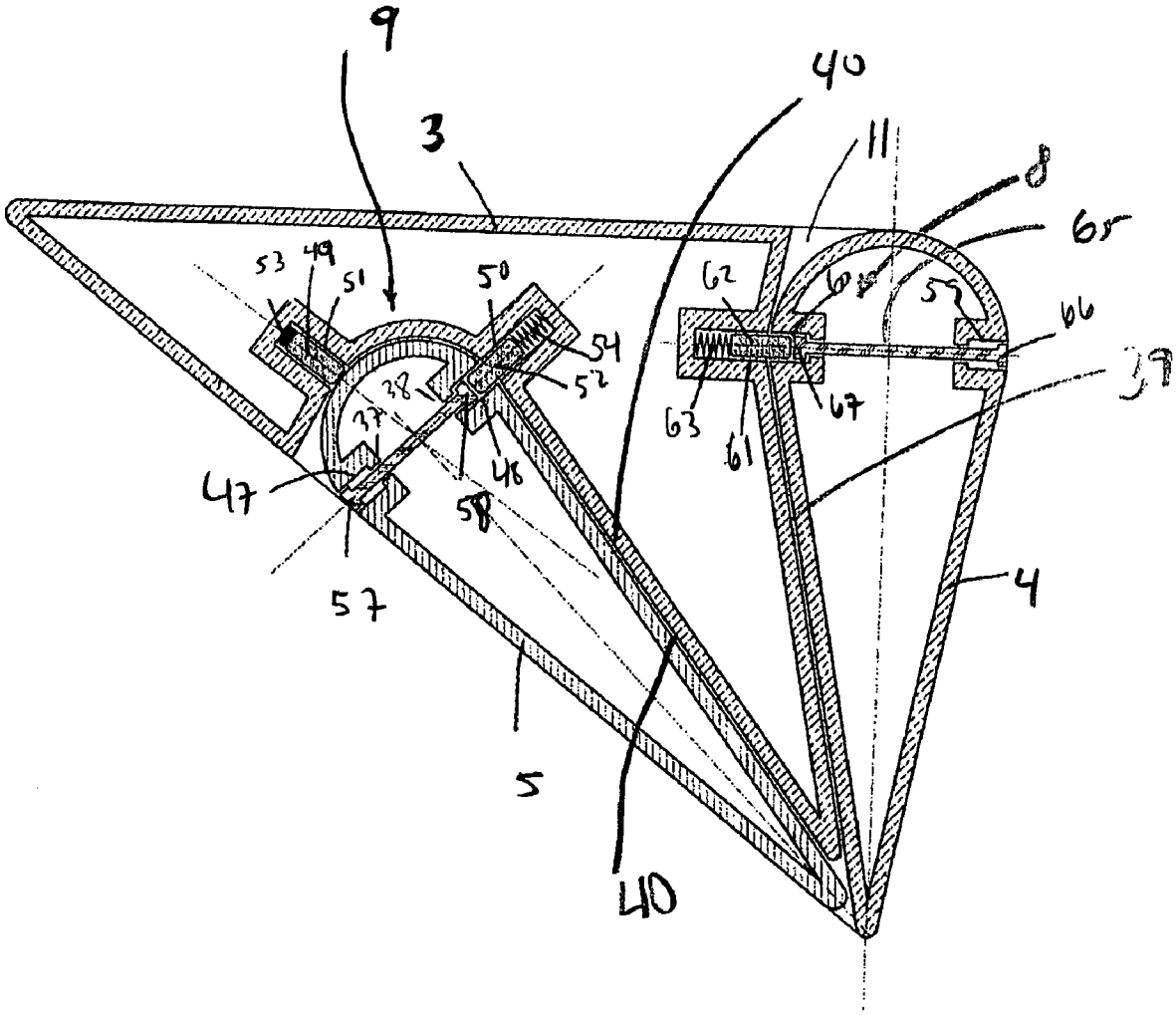
FIG. 12 is a side cross sectional view of the foldable chair where the backrest and leg are retracted.

When the backrest 4 and leg 5 are both retracted, as illustrated in FIGS. 4 and 12, the chair 1 forms a wedge shape as indicated, or more generally, a uniform prism shape. The wedge has first and second geometric faces defining the first and second sidewalls 10, 11, a third geometric face defining the seat 3 and a fourth geometric face defining the backrest 4.

Figure 13:
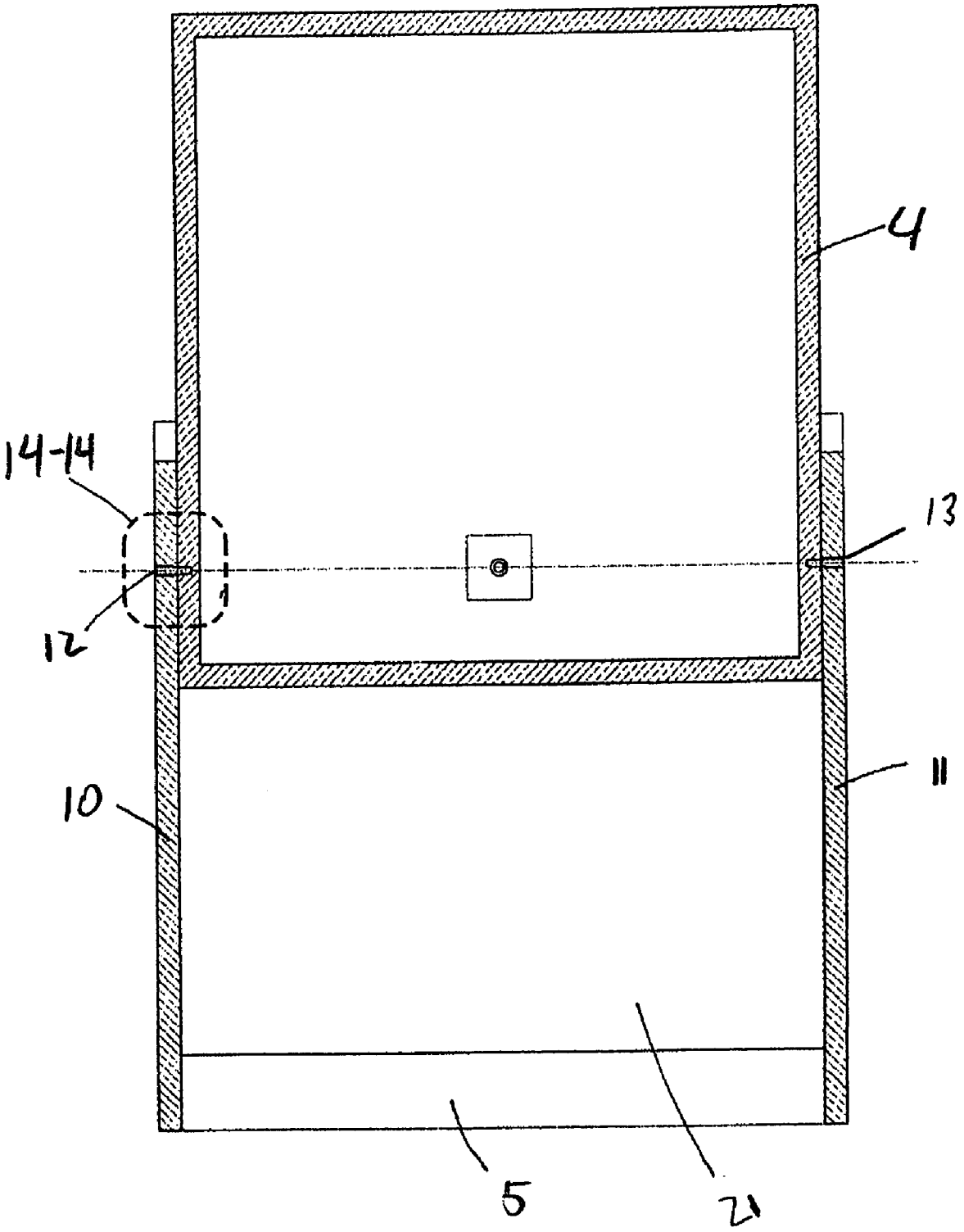
FIG. 13 is a rear cross sectional view of the foldable chair where the backrest and leg are extended.
Figure 14:
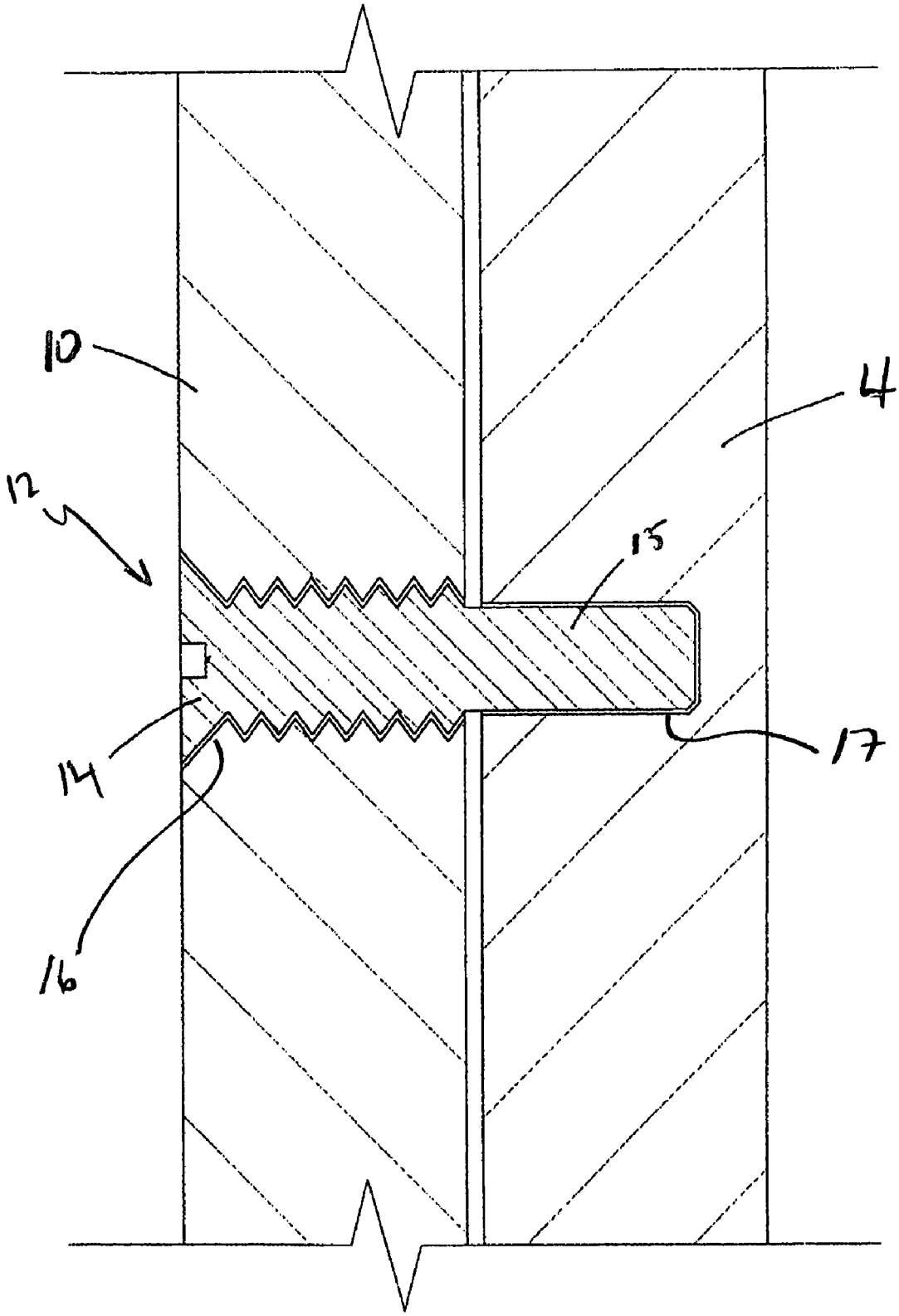
FIG. 14 is a cross sectional view of segment 14-14 of FIG. 13.

As illustrated in FIG. 1, the backrest 4 is pivotable about a common edge of the wedge shaped chair between the backrest 4 and the seat 3. Turning to FIGS. 13-14, the pivotal connection of the backrest 4 is provided via axially aligned pins 12, 13. Pin 12 is illustrated in FIG. 14 having an axial proximal end 14 and an axial distal end 15. The axial proximal end 14 is threaded and mates with a threaded through hole 16 in the sidewall 10. The axial distal end 15 of the pin 12 has a smooth outer circumference and mates with a smooth borehole 17 in the backrest 4. The connection between the pin 13 and the backrest 4 is the same as the connection between the pin 12 and the backrest 4 allowing the backrest 4 to pivot against the chair frame 2.

Figure 5:
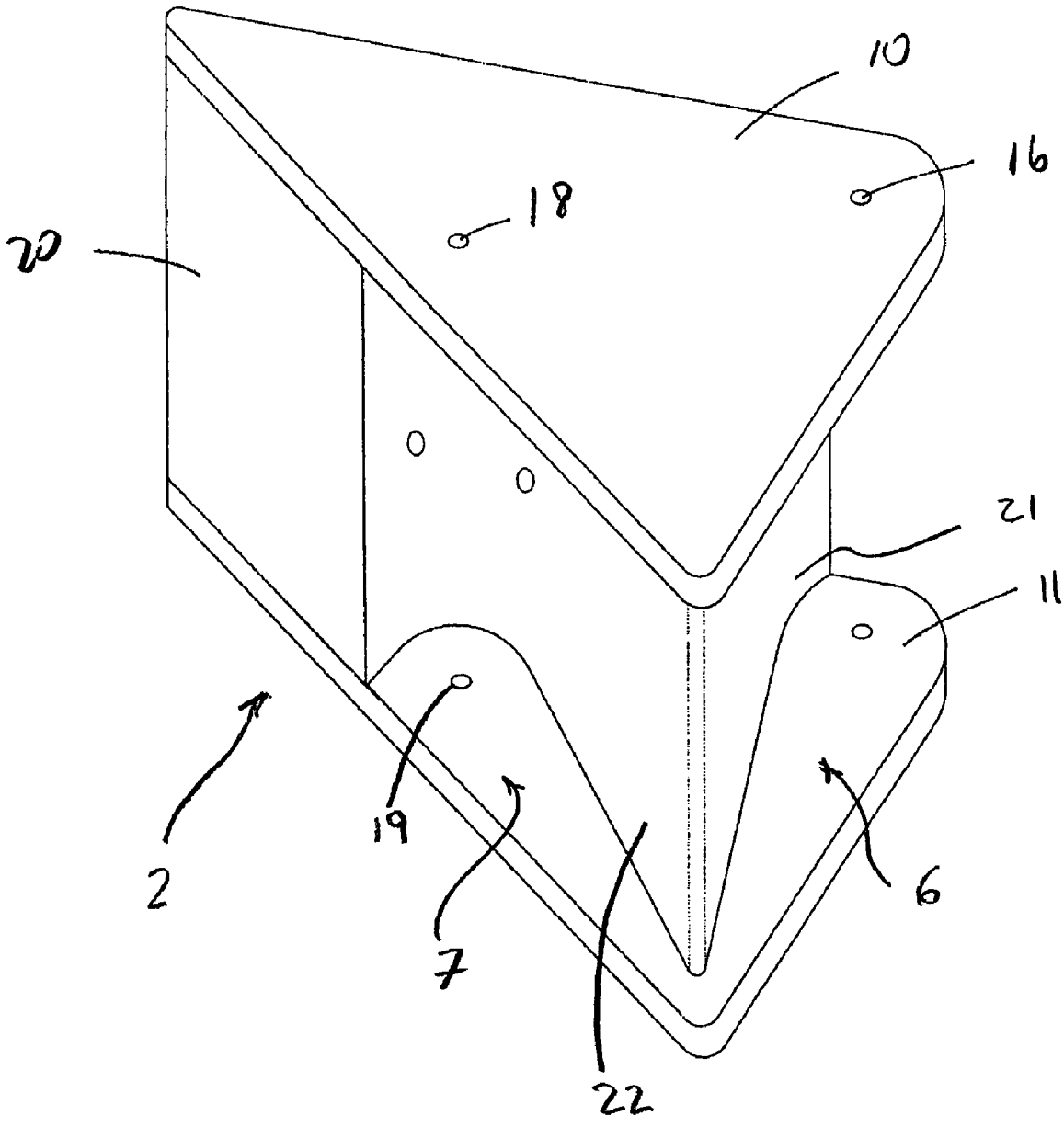
FIG. 5 is a perspective view of the foldable chair without a backrest or leg.

When the backrest 4 and the leg 5 are retracted, the wedge shaped structure has a fifth geometric face disposed between the first and second sidewalls 10, 11. The fifth face opposes the seat 3 and is outwardly pivotable for forming the leg 5. The leg 5 is pivotally connected to the chair frame 2 in a like manner as the backrest to the frame 2, i.e., via partially threaded pins. For accommodating the pin connections between the leg and the frame 2, the sidewalls 10, 11 are provided with through holes 18, 19 as illustrated in FIG. 5.

In the illustrated embodiment, the wedge shape of the frame 2 is formed by the first and second sidewalls 10, 11 which are triangular, and the seat 3, backrest 4 and leg 5, which are rectangular. However, as indicated, the chair can manufactured in a more general prism shape, such as a rectangular parallelepiped, in which case a front leg is not necessary or alternatively a front and a back leg are both provided.

Figure 10:
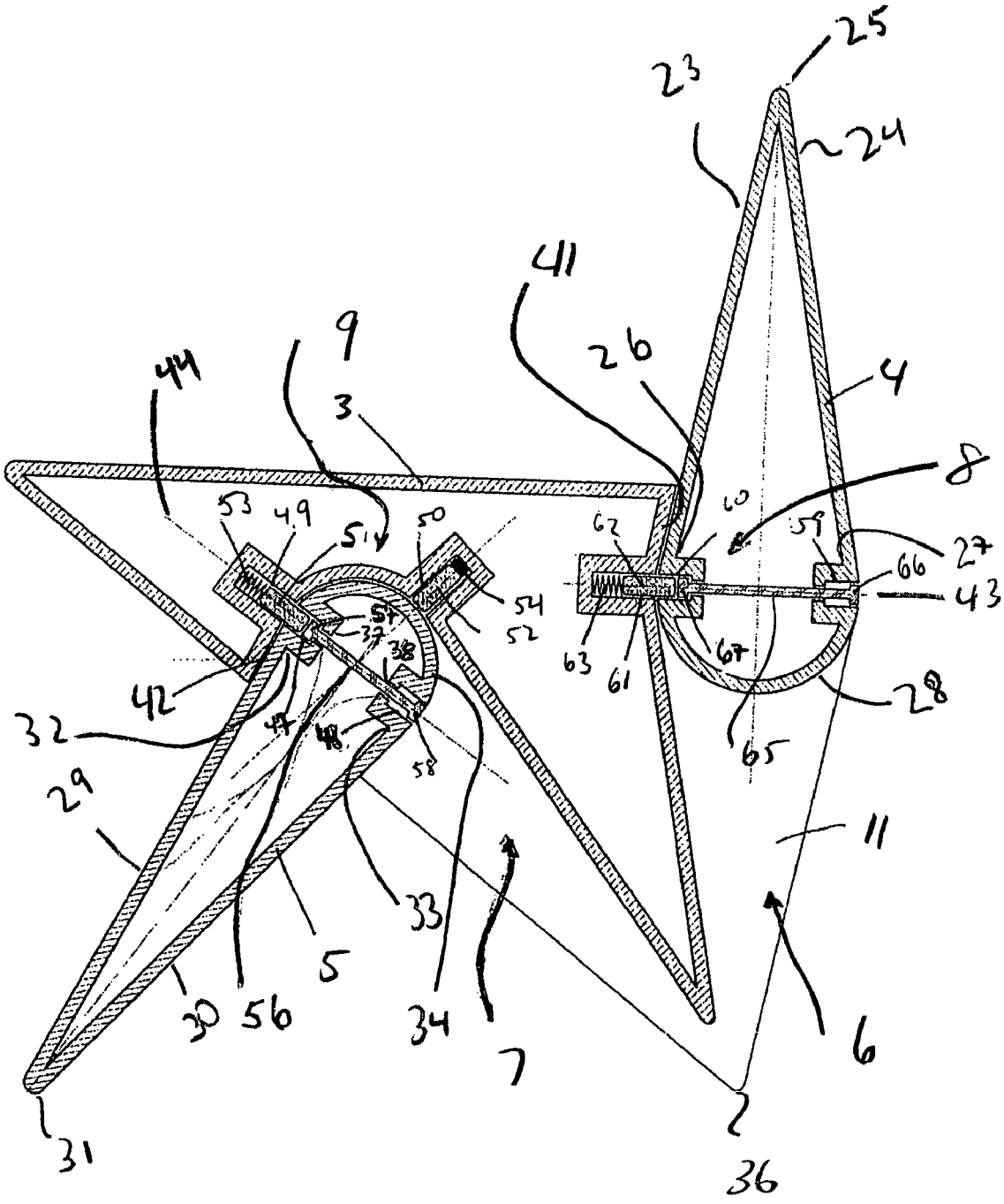
FIG. 10 is a side cross sectional view of the foldable chair where the backrest and leg are extended.

As illustrated in FIG. 10, the backrest 4 and leg 5 each also form a wedge. The backrest 4 has opposing rectangular faces 23, 24 connected at a common edge 25 and connected at bottom edges 26, 27 of the opposing rectangular faces is a radial base 28. Similarly, leg 5 has opposing rectangular faces 29, 30 connected at a common edge 31 and connected at bottom edges 32, 33 of the opposing rectangular faces is a radial base 34. For each of the backrest 4 and the leg 5, the cross sectional shape above the respective base 28, 34 is an isosceles triangle.

The height of the triangle forming the backrest 4 is that required to provide a comfortable seating position for a person. The height of the triangle forming the leg 5 is that required to render the seat 3 in a substantially horizontal position, or parallel to a floor, when the leg 5 is extended. In such a configuration of the leg 5, the top edge 31 of the leg 5 is positioned against a floor as is bottom edges 35, 36 (FIG. 6) of each sidewall 10, 11. It should be appreciated that the bottom edges 35, 36 of each sidewall 10, 11 are the edges connecting the geometric fourth and fifth faces of the wedge when the backrest 4 and leg 5 are retracted.

Figure 6:
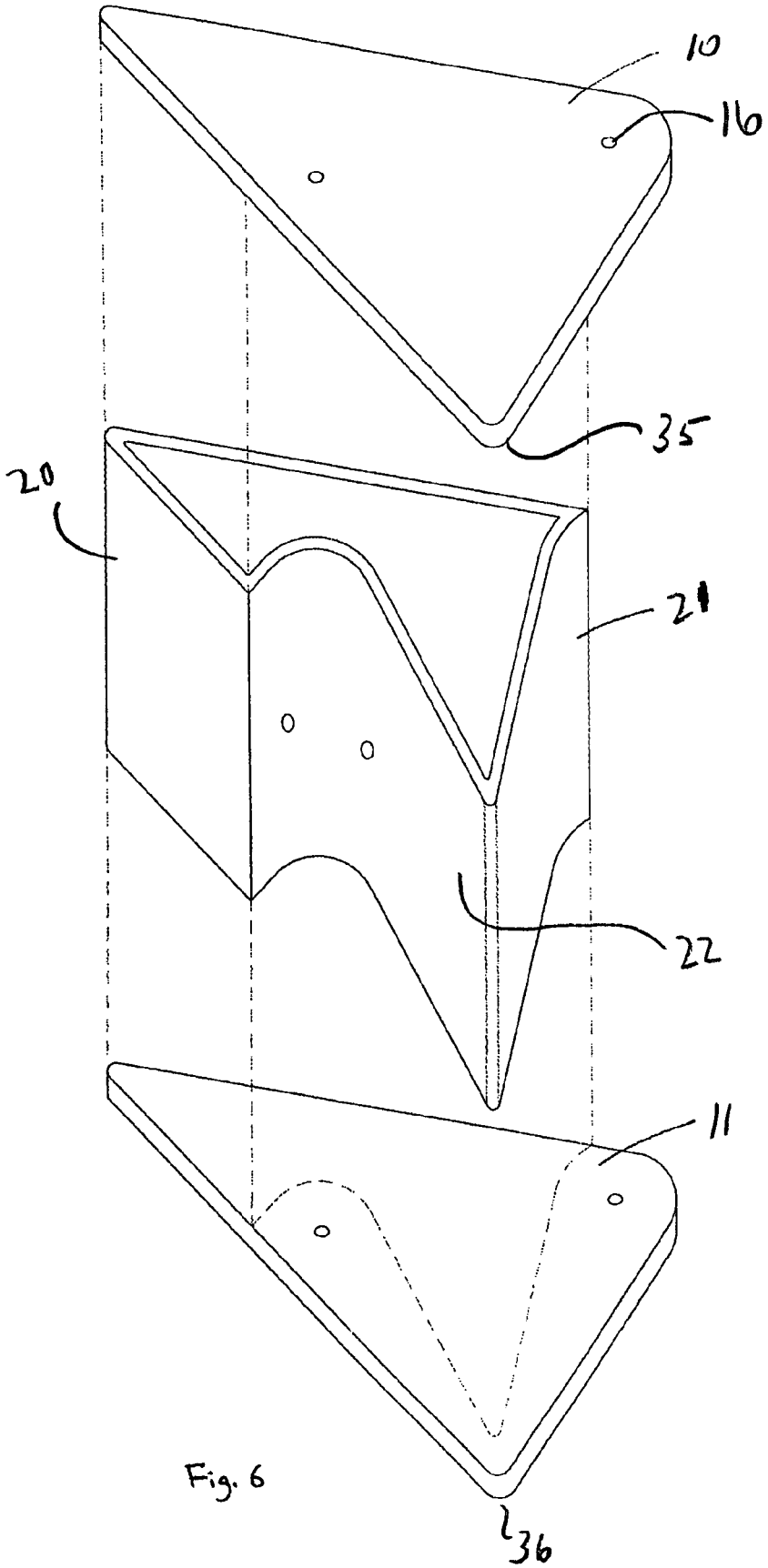
FIG. 6 is an exploded view of the foldable chair without the backrest or leg.

FIGS. 5 and 6 illustrate that the sidewalls 10, 11 are plates and disposed therebetween is a spacer 20. The spacer 20 forms the seat 3 and the spacer includes first and second chamber surfaces 21, 22 each disposed between the first and second sidewalls 10, 11 and respectively forming the first and second chambers 6, 7 disposed within the wedge for receiving ones of the backrest 4 and the leg 5.

The first and second chamber surfaces 21, 22, each have an arcuate cross-sectional shape. As illustrated in FIG. 12, the chamber surfaces 21, 22 each have a first segment 39, 40 for pressing against the backrest 4 and leg 5 and defining a maximum inward pivot when the backrest 4 and chair 5 are retracted. As illustrated in FIG. 10, each chamber surface 21, 22 has a second portion 41, 42 for pressing against the backrest 4 and leg 5 and defining a maximum outward pivot when the backrest 4 and leg 5 are extended.

Illustrated in FIG. 10, the backrest 4 is configured such that when extended, an axis 43 passing through the radial center of the base 28 is parallel to the seat 3 while an axis extending through the center of the isosceles triangle defining the backrest is perpendicular to the seat 3. Furthermore, the leg 5 is configured such that when extended, an axis 44 passing through the radial center of the base 34 is parallel to the plane disposed along the exterior of the geometric fifth face of the wedge while an axis extending through the center of the isosceles triangle defining the leg is perpendicular to the geometric fifth face of the wedge.

Based on the above configuration, the size of the base 28 of the backrest 3 is defined such that an angle between the backrest 4 and the seat 3 provides a comfortable sitting position when the backrest 4 is extended. On the other hand, the size of the base 34 of the leg 5 is a function of design appeal based on readily available and appropriate materials. However, one skilled in the art would recognize that a larger radius of the leg base 34 provides a greater distribution of the shear forces within the leg 5 and such will have known implications on design materials, thickness, etc.

Figure 11:
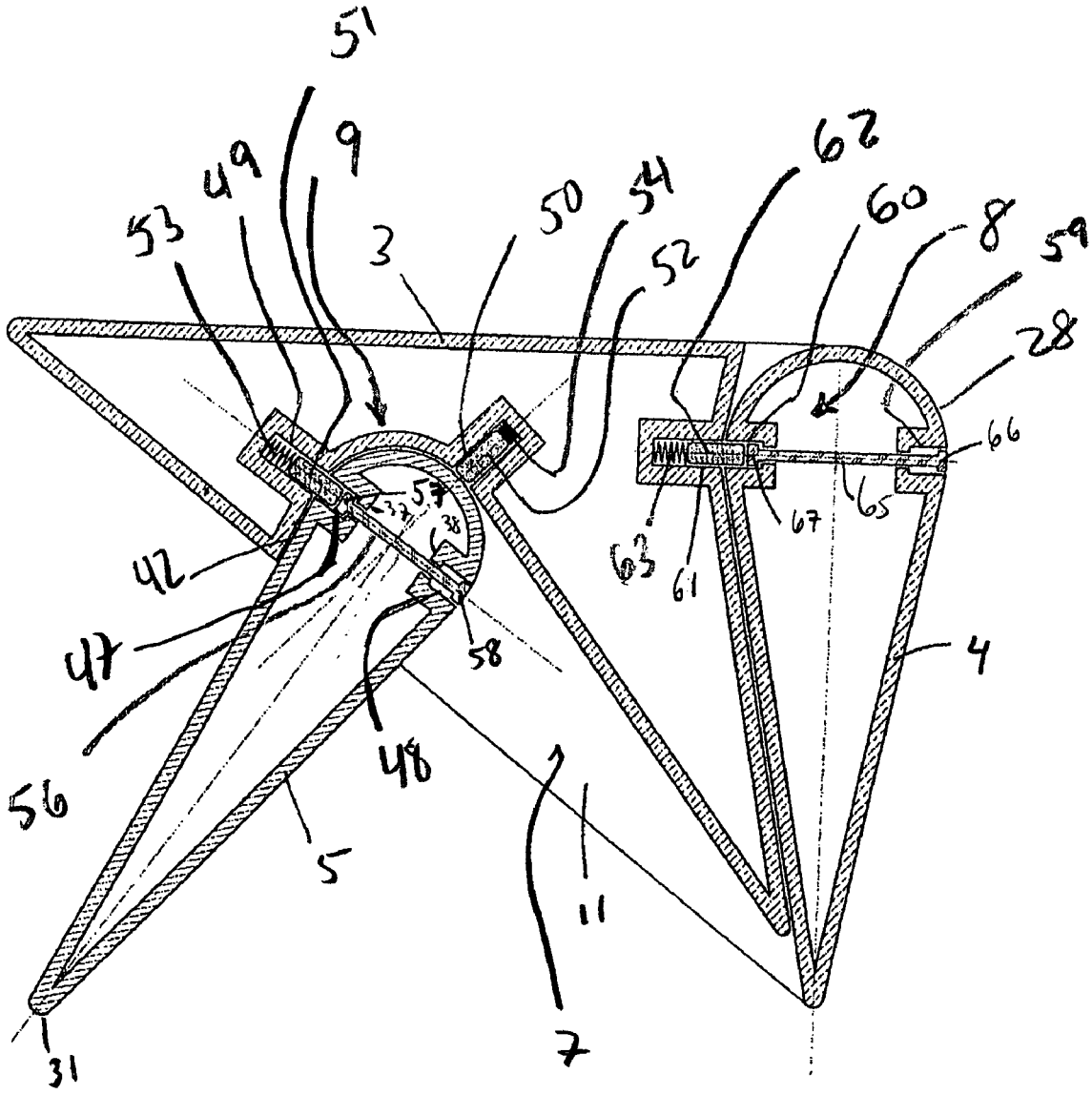
FIG. 11 is a side cross sectional view of the foldable chair where the backrest is retracted and leg is extended.

Illustrated in FIGS. 10 and 11 is the backrest locking means 8 and the leg locking means 9 for locking respective ones of the backrest 4 and the leg 5 in the extended or retracted positions. The leg locking means 9 includes first and second axially extending leg base cavities 47, 48 disposed at radial opposing ends of the leg base 34. The diameter of the leg base cavities 47, 48 is that required for allowing a person's finger to extend comfortably therein when releasing the locking feature of the leg locking means 9.

First and second axially extending leg chamber cavities 49, 50 are disposed in the leg receiving chamber 7. The leg chamber cavities 49, 50 in the leg receiving chamber 7 respectively include first and second axially movable locking rods 51, 52 and coupled springs 53, 54 for biasing the locking rods 51, 52 in the direction of the leg base 34. The diameter of the locking rods 51, 52 is that required for providing minimum radial motion when the rods 51, 52 are disposed in the leg base cavities 47, 48 yet also enabling axially frictionless travel of the locking rods 51, 52 between the leg chamber cavities 49, 50 and the leg base cavities 47, 48. The diameters of the leg chamber cavities 49, 50 are illustrated as being substantially that of the leg base cavities 47, 48.

When the first locking rod 51 extends into the first leg base cavity 47, the leg 5 is locked in the extended state and the front of the chair 1 is capable of being supported by the edge 31 of the leg 5. On the other hand, when the second locking rod 52 extends into the second leg base cavity 48, the leg 5 is locked in a retracted state.

In each of the leg base cavities 47, 48, there exists a radially extending seat 37, 38 at an axial innermost portion thereof. Each seat has an opening for providing an effective axial passage between the leg base cavities 47, 48. Each opening has a smaller diameter than the remainder of the leg base cavities 47, 48. An axially movable release rod 56 extends between and into both leg base cavities 47, 48. Each axial end 57, 58, i.e., first and second heads of the release rod 56, has a larger diameter than the openings in the respective seats 37, 38 for preventing the release rod 56 from slipping through the respective seats 37, 38 and for providing a relatively greater force distribution when the release rod 56 is advanced against the locking rods 51, 52 for releasing the locking feature of the leg locking means 9. As illustrated, each head 37, 38 has the same diameter as the diameter of the locking rods 51, 52.

The release rod 56 is axially longer than the axial distance between the seats 37, 38. Accordingly, when the first locking rod 51 extends into the first leg base cavity 47, the first head of the release rod 57 becomes disposed against the first seat 37 while the second head of the release rod 58 becomes flush with an outer surface of the leg base 34. In this configuration, the second head of the release rod 58 is capable of being easily accessed and biased, or pushed by a user, whereby the first head of the release rod 57 advances against the first locking rod 51 until the first head 57 becomes flush with the outer surface of the leg base 34. The leg 5 is thereby released and movable into the retracted state.

Based on the above configuration, the axial length of the locking rods 51, 52 is illustrated as being such that at least half of the length of the locking rods remains in the leg chamber cavities while the other half presses the respective head of the release rod against the respective seat. On the other hand, the length is short enough so that when the release rod has advanced against the locking rod, the locking rod is entirely contained in the respective chamber cavity. This assures that each locking rod will function to lock the leg base and release the leg base as needed.

As can be appreciated, once the leg base 34 is rotated by the user so that the first leg base cavity 47 is out of alignment with the first leg chamber cavity 49, the first locking rod 51 will be incapable of advancing into the first leg base cavity 47. At this point, the user will be able to remove their finger from the second leg base cavity 48 as biasing of the release rod 56 will no longer be required.

Upon reaching the retracted state, the second locking rod 52 extends into the second leg base cavity 48. At this time, the second end of the release rod 58 is advanced against the second seat 38 while the first end of the release rod 57 becomes flush with the outer surface of the leg base 34. In this configuration, the first end of the release rod 57 is capable of being biased, or pushed by the user, whereby the second end of the release rod 58 advances against the second locking rod 52. The leg 5 is thereby released and movable into the extended state.

Turning to the backrest locking means 8, this structure is similar to the leg locking means 9. The difference is that there is only one backrest chamber cavity 61 so that the leg 5 has to pivot 180 degrees between an extended and a retracted state.

More specifically, the backrest locking means 8 includes first and second backrest base cavities 59, 60 disposed at radial opposing ends of said backrest base 28. Each backrest base cavity 59, 60 includes an innermost seat 45, 46, an associated opening and a release rod 65 disposed therebetween, where the release rod has opposing axial ends, or first and second heads, 66, 67. In the backrest chamber cavity 61, an axially movable locking rod 62 and coupled spring 63 are provided for biasing the locking rod 62 towards the base of the backrest 28.

The axial and radial proportions between the components of the backrest locking means 8 are the same as that in the leg locking means 9. When the locking 62 rod extends into the first backrest base cavity 59, the backrest 4 is locked in the extended state. On the other hand, when the locking rod 62 extends into the second backrest base cavity 60, the backrest 4 is locked in the retracted state. To change between the retracted and the extended states, the appropriate head of the release rod 65 is biased, or pushed by the user, until the head reaches the cavity seat in the respective backrest base cavity. At this point the locking rod is completely retracted into the single chamber cavity so the backrest can be pivoted.

As has been explained above, both the leg and the backrest are pivotally connected to the sidewalls, such that when both components are retracted, the leg and the backrest are covered within the triangular shape of the sidewalls and the overall structure forms a wedged shape. The geometry provides the use of the chair with an alternative furniture piece, such as a table, or with as seat even in the retracted state. Moreover, the locking means fixes the leg and backrest when these components are extended or retracted and the release rod provides a one touch release system for enabling the extending and retracting of the components of the foldable chair.

Figure 3:
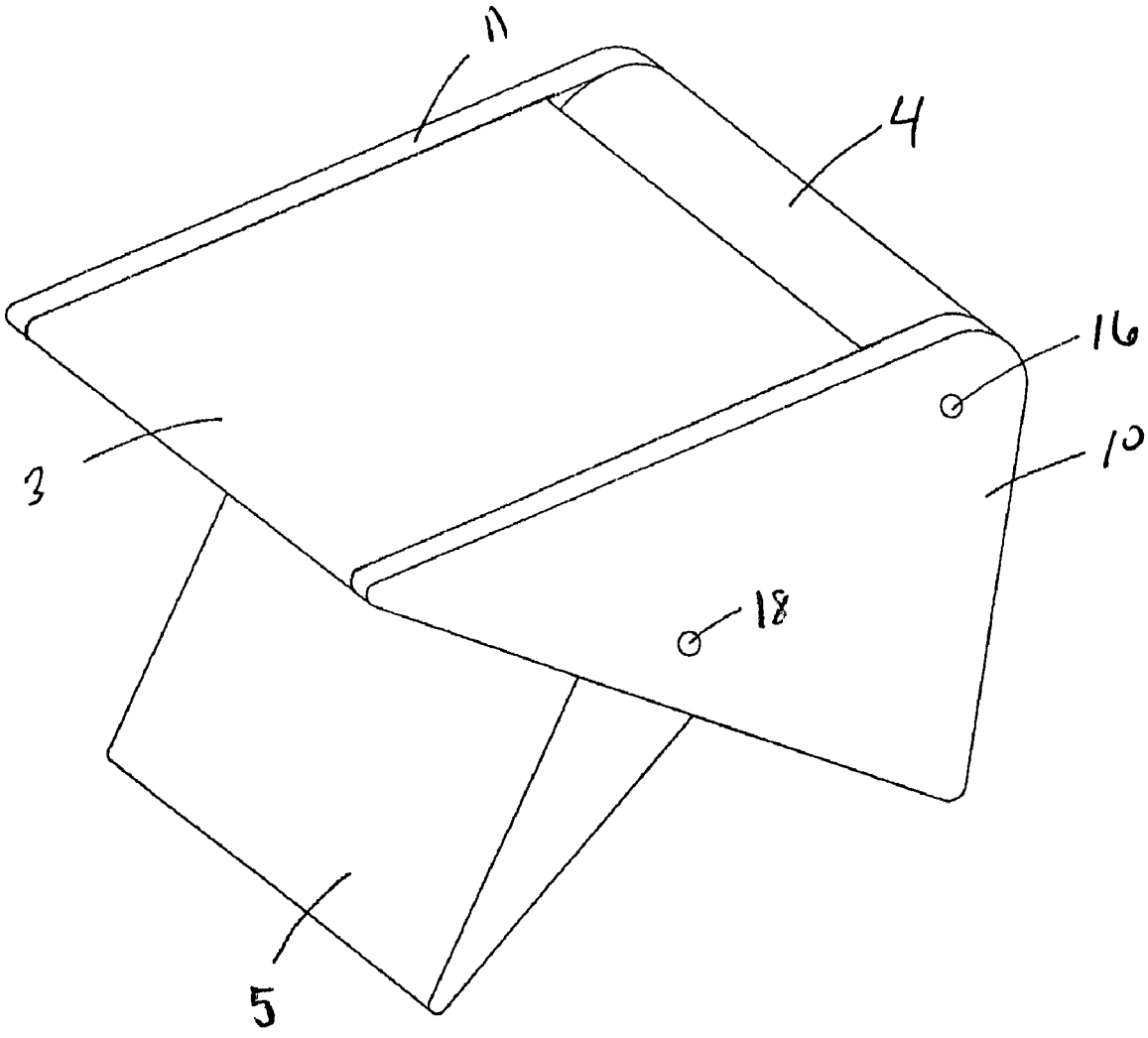
FIG. 3 is a perspective view of the foldable chair where the backrest is retracted and the leg is extended.

In one folded configuration, both the back and the leg are extended to form the chair. Alternatively, when the back is folded (FIG. 3), the chair can still be used as a seat or, optionally a table.

In another configuration when both the back and the front leg are retracted and the structure is placed on a sidewall (FIG. 4), the resulting furniture configuration can also be used as a table. This is also the configuration for storage and shipping.

Moreover, when a person sits, the leg, which is a front leg, is forced open to a greater extent due to the angle that the front leg is set. However, the inside surface of the leg chamber holds the front leg preventing an extensive application of shearing forces on the pins.

The present invention may be embodied in other specific forms without departing from its spirit or essential characteristics. The described embodiments are to be considered in all respects only as illustrative and not as restrictive. The scope of the invention is, therefore, indicated by the appended claims and their combination in whole or in part rather than by the foregoing description. All changes that come within the meaning and range of equivalency of the claims are to be embraced within their scope.

The invention claimed is:

1. A foldable chair comprising:

first and second opposing parallel faces having a same shape and size forming sidewalls of said chair, a seat extending between said first and second sidewalls, and a pivotal backrest disposed between said first and second sidewalls;

wherein said chair is capable of being disposed in a folded state wherein said backrest is retracted and whereby said chair forms uniform prism, said prism having first and second faces forming said first and second sidewalls, said seat forming a third face and a said backrest, in the retracted state, forming a fourth face;

wherein said backrest is pivotable about a common edge with said seat;

wherein a fifth face of said prism that opposes said seat is outwardly pivotable for forming a leg, said leg disposed between first and second sidewalls;

wherein said prism forms a wedge and said first and second sidewalls are triangular and said seat, backrest and leg are rectangular;

wherein said sidewalls are triangular plates and disposed there between is a spacer;

said spacer forming said seat and including first and second chamber surfaces; and each of said chamber surfaces being disposed between said first and second sidewalls and respectively forming a backrest receiving chamber and a leg receiving chamber.

2. The chair of claim 1, wherein said leg and backrest each form a wedge, each having opposing rectangular faces connected at a common top edge and a radial base connecting a bottom edge of the rectangular faces.

3. The chair of claim 2, wherein said first and second chamber surfaces have an arcuate cross-sectional shape, each having a first segment for pressing against said backrest and leg and defining a maximum inward pivotal position when said backrest and leg are retracted and a second portion for pressing against said backrest and leg and defining a maximum outward pivotal position when said backrest and leg are extended.

4. The chair of claim 3, further comprising backrest locking means and leg locking means for locking respective ones of the backrest and the leg in the maximum outward or inward pivotal position.

5. The chair of claim 4, wherein said leg locking means includes:

first and second axially extending leg base cavities disposed at radially opposing ends of said leg base; and first and second axially extending chamber cavities disposed in said leg receiving chamber, respectively including first and second axially movable locking rods and coupled springs for biasing said locking rods against said leg base;

wherein when said first locking rod extends into said first leg base cavity, said leg is locked in an extended state and when said second locking rod extends into said second leg base cavity, said leg is locked in a retracted state.

6. The chair of claim 5, wherein said leg locking means further includes:

a radially inwardly extending seat in an innermost portion of each of said base cavities, each seat including a diametrical opening having a smaller diameter than said seat; and an axially extending movable release rod extending into each of said leg base cavities through said seat openings, each axial end of said release rod defining a head having a larger diameter than said seat openings for preventing said release rod from slipping through said seat openings;

said release rod having an axial length so that when said first locking rod extends into said first leg base cavity, said release rod is capable of being axially biased against said first locking rod whereby said leg is released and movable into the retracted state, and when said second locking rod extends into said second leg base cavity, said release rod is capable of being axially biased against said second locking rod whereby said leg is released and movable into said extended state.

7. The chair of claim 4, wherein said backrest locking means includes:

first and second backrest base cavities disposed at radial opposing ends of said backrest base; and an axially extending cavity disposed in said backrest receiving chamber that includes an axially movable locking rod and coupled spring for biasing said locking rod against said backrest;

wherein when said locking rod extends into said first backrest base cavity, said backrest is locked in an extended state and when said locking rod extends into said second backrest base cavity, said backrest is locked in a retracted state.

8. The chair of claim 7, wherein said backrest locking means further includes:

a radially inwardly extending seat in an innermost portion of each of said base cavities, each seat including a diametrical opening having a smaller diameter than said seat; and an axially extending movable release rod extending into each of said backrest base cavities through said seat openings, each axial end of said release rod defining a head having a larger diameter than said seat openings for preventing said release rod from slipping through said seat openings;

said release rod having an axial length so that when said locking rod extends into said first backrest base cavity, said release rod is capable of being axially biased against said locking rod whereby said backrest is released and movable into the retracted state, and when said locking rod extends into said second backrest base cavity, said release rod is capable of being axially biased against said locking rod whereby said backrest is released and movable into the extended state.

* * * * *